US006948570B2

(12) United States Patent
Kristen et al.

(10) Patent No.: US 6,948,570 B2
(45) Date of Patent: Sep. 27, 2005

(54) ELECTRICAL HAND TOOL MACHINE WITH VIBRATION DAMPED STRIKING MECHANISM

(75) Inventors: Ferdinand Kristen, Gilching (DE); Erwin Manschitz, Germering (DE)

(73) Assignee: Hilti Aktiengesellschaft, Schaan (LI)

( * ) Notice: Subject to any disclaimer, the term of this patent is extended or adjusted under 35 U.S.C. 154(b) by 125 days.

(21) Appl. No.: 10/718,178

(22) Filed: Nov. 20, 2003

(65) Prior Publication Data

US 2004/0108124 A1 Jun. 10, 2004

(30) Foreign Application Priority Data

Nov. 23, 2002 (DE) ..... 102 54 813

(51) Int. Cl.[7] ..... B25D 17/00

(52) U.S. Cl. ..... 173/162.1; 173/162.2; 173/170; 173/217

(58) Field of Search ..... 173/162.1, 162.2, 173/170, 217; 310/47, 50; 439/358, 405

(56) References Cited

U.S. PATENT DOCUMENTS 4,711,308 A * 12/1987 Blaas et al. ..... 173/162.2
5,054,944 A * 10/1991 Matsuyama ..... 400/679
6,076,616 A * 6/2000 Kramp et al. ..... 173/162.2
6,520,266 B2 * 2/2003 Bongers-Ambrosius et al. ..... 173/2
6,758,288 B2 * 7/2004 Richter et al. ..... 173/217
6,799,643 B2 * 10/2004 Voulkidis et al. ..... 173/170

FOREIGN PATENT DOCUMENTS

GB 2154497 A * 9/1985 ..... B25D/17/24

* cited by examiner

*Primary Examiner*—Stephen F. Gerrity
*Assistant Examiner*—Chukwurah Nathaniel
(74) *Attorney, Agent, or Firm*—Abelman, Frayne & Schwab

(57) ABSTRACT

A partially percussive electrical hand tool machine (1) having a portable housing (3), a striking mechanism module (4) connected, in a vibration-damped manner, to the housing (3) and having electrical lines (5) for electrical connection of the relatively moveable striking mechanism module (4) to the housing (3). The electrical lines (5) are non-vibrationally attached in a bending flexible wiring bridge (7) arranged transverse to the striking axis (A).

9 Claims, 2 Drawing Sheets

ELECTRICAL HAND TOOL MACHINE WITH VIBRATION DAMPED STRIKING MECHANISM

BACKGROUND OF THE INVENTION

The invention relates to an at least partially percussive electrical hand tool machine having a portable housing and a striking mechanism module vibrationally-damped thereto, in particular a chisel hammer.

The pneumatic striking mechanism, in percussive electrical hand tool machines, usually driven by an electric motor and the interaction of the work piece with the percussive tool cause inertia-related vibrations that are transmitted through the housing to the operator, in the frequency range of 1 Hz to 100 Hz, which should be suppressed as much as possible. These type of striking mechanism modules that are vibration-damped using a spring to the housing are limited displaceable, approximately 10 mm, for producing a different pre-stressing along the striking axis and vibrate about this central position with an amplitude of a few millimeters.

According to GB 215 4 497, an electrical hand tool machine has a striking mechanism module that is vibration damped by the housing, wherein the electrical motor that is solidly connected to the housing has a limited moveable engagement along the striking axis in the striking mechanism module.

According to DE 100 0 8671, the electrical motor, in an electrical hand tool machine, is connected to the housing via long, freely suspended lines. Such long, freely suspended lines have a very low resistance to bending because of their punctiform cross section and have a low intrinsic resonance relative to bending vibration modi, which can undergo a resonant excitation in the event of vibrations and which can result in failure due to material fatigue.

In addition, according to EP 0 276 313, a flat ribbon like cable harness between parts of a robot limited moveable relative to each other has a moveable flat rigid supporting structure, to which the cables are fastened. According to U.S. Pat. No. 5,054,944, a moveable printing head has a flat ribbon like cable harness that is flexible in one dimension and is a flexible circuit board made of plastic, which extends along the movement.

SUMMARY OF THE INVENTION

The object of the invention is to provide a vibration-damped striking mechanism module with a low-fatigue current supply.

This object is achieved, in accordance with the invention, by an at least partially percussive electrical hand tool machine having a portable housing and a striking mechanism module that is vibration damped relative to the housing has a plurality of electrical lines for electrical connection to the striking mechanism module that is limited displaceable relative to the housing, wherein the lines are non-vibrationally fastened in a flexible wiring bridge arranged transverse to the striking axis.

The individual lines fixed in the non-oscillating flexible wiring bridge arranged transverse to the striking axis form with the wiring bridge a virtually vibration-free module, which is more rigid than a single line and has essentially higher bending intrinsic vibration modi that are separated from the excitation spectrum in the frequency range to prevent resonant excitations.

Advantageously, the wiring bridge has a plurality of longitudinally separated guide means for individual locking guidance of the line and fastening means that can be attached, preferably clipped on, such that the lines can be fastened to discrete sites.

Advantageously, the wiring bridge is flexibly bent relative to one bending axis oriented transverse to the striking axis and in another rigidly configured, as a ribbon, whereby transverse vibrations are suppressed.

Advantageously, the wiring bridge is made of plastic, preferably unreinforced polyamide, whereby a high and low-fatigue vibration damping results via the viscoelastic behavior.

A plug connector that can be displaced along the wiring bridge is arranged at the terminus of the wiring bridge, whereby with the non-vibrational assembly, a latent stress-free fastening relative to the wiring bridge can be made.

Advantageously, a friction-locking fastening of the plug connector to the wiring bridge is practiced using an intervening rib, whereby the plug connector can be fixed and displaceable using an assembly screw.

Advantageously, the wiring bridge projecting at one side is secure with the electronics module, preferably bonded to the electronics module via a casting mass, whereby the wiring bridge is a pre-installable part of the electronics module.

SUMMARY OF THE INVENTION

The exemplary embodiment of the invention will be more completely described with reference to the drawings, wherein.

DETAILED DESCRIPTION OF THE INVENTION

Figure 1:
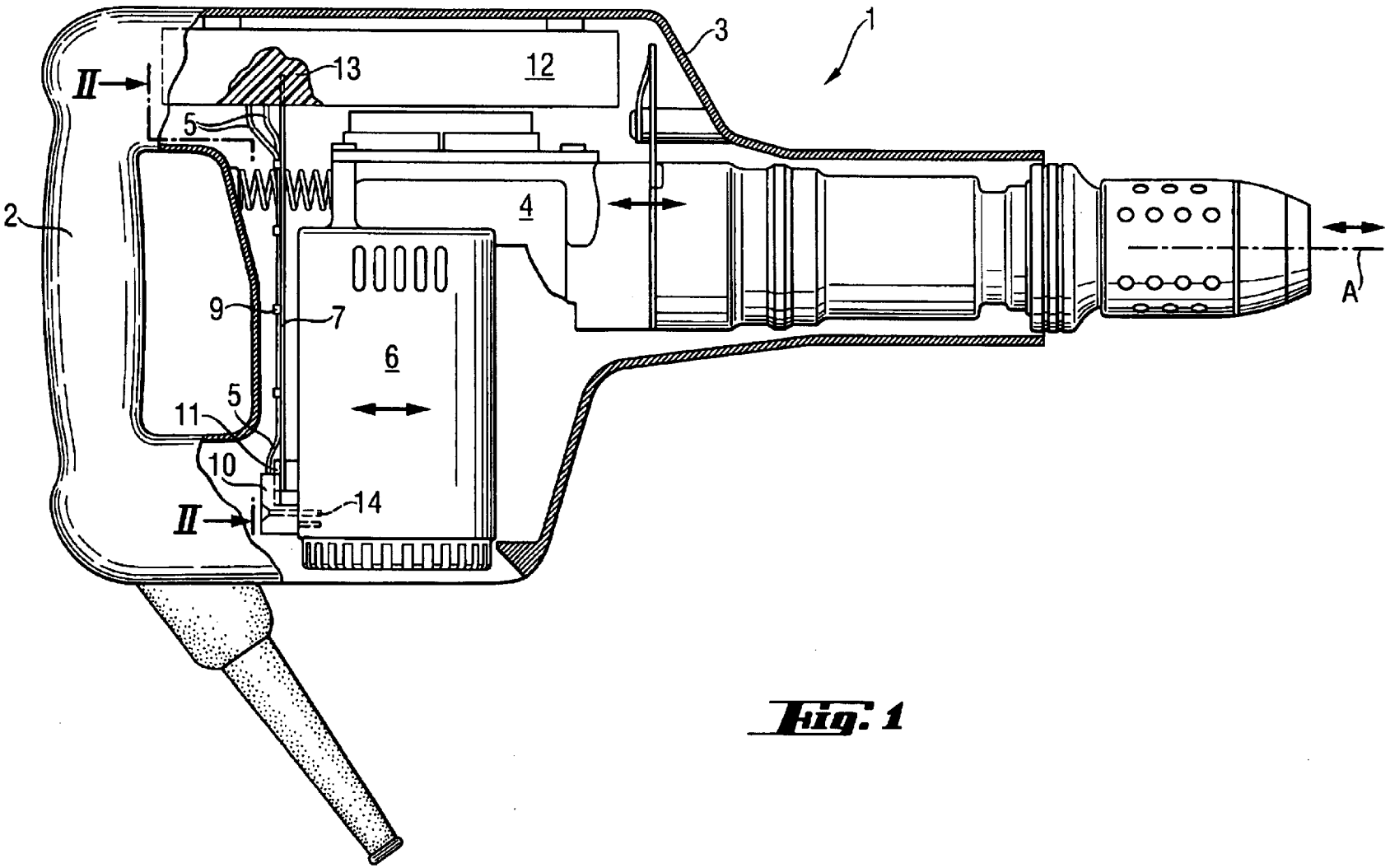
FIG. 1 shows an electrical hand tool machine, partially represented in longitudinal section, according to the invention.

FIG. 1 shows a rotary and percussive electrical hand tool machine 1 having a housing 3 portable using a handle 2 and a striking mechanism module 4 relatively limited moveable along the striking axis A and connected vibration-damped thereto has a plurality of flexible, electrical lines 5, which connects the housing 3 and the striking mechanism module 4, which contain an electrical motor. The lines 5 are non-vibrationally attached to a wiring bridge 7 arranged transverse to the striking axis A, which is connected projecting and secure with an electronics module 12, in that is bonded to said latter via a casing mass 13. A plug connector 10 non-vibrationally mounted at the terminus of the wiring bridge 7 connected the electronics module 12 electrically with the electrical motor 6.

Figure 2:
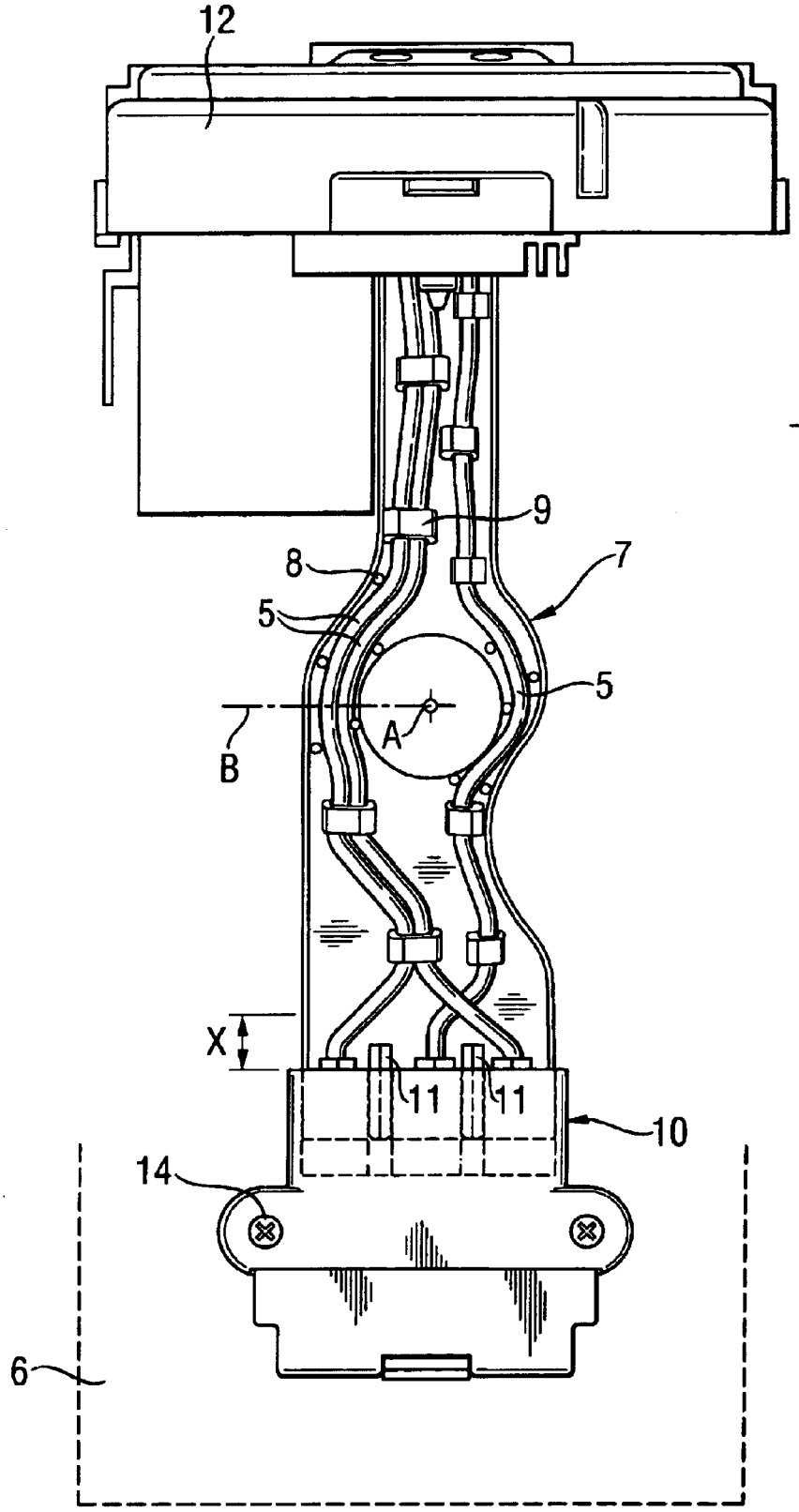
FIG. 2 shows a wiring bridge, viewed in section along the plane II—II of FIG. 1.

According to FIG. 2, the lines 5 are fastened non-vibrationally, in a defined bending flexible wiring bridge 7, arranged transverse to the striking axis A, relative to precisely one bending axis B oriented transverse to the striking axis A. When this is done, the bending flexibility by virtue of a suitable thickness of the wiring bridge 7 is chosen such that the first bend intrinsic vibration of the wiring bridge 7 configured as a ribbon made of polyamide, is greater than 200 Hz relative to the bend axis B. The wiring bridge 7 has a plurality of longitudinally spaced guide means 8 for individual locking guidance of the lines 5 and clip fastening means 9 for fastening. The plug connector 10, which is displaceable along the bridge, in the zone X, is arranged at the terminus of the wiring bridge 7, which is fixed using two intervening ribs 11 locked, in a friction manner, to the wiring bridge, such that the plug connector 10, which is mounted, in a non-vibrating manner, on the electrical motor 6 using screws 14, creates a pressure bias via the ribs 11.

What is claimed is:

1. An at least partially percussive electrical hand tool machine having a portable housing (3), a striking mechanism module (4) connected vibration-damped to the portable housing (3) and having a plurality of electrical lines (5) for electrical connection of the striking mechanism module (4) that is moveable relative to the housing (3), wherein the electrical lines (5) are non-vibrationally attached in a bending flexible wiring bridge (7) arranged transverse to the striking axis (A).

2. The electrical hand tool machine of claim 1, wherein the wiring bridge (7) has a plurality of longitudinally spaced guide means (8) for individual locking guidance of the lines (5).

3. The electrical hand tool machine of claim 2, wherein the wiring bridge (7) has clip fastening means (9) that can be attached to the lines (5).

4. The electrical hand tool machine of claim 1, wherein the wiring bridge (7) is flexibly bent relative to one bend axis (B) oriented transverse to the striking axis (A).

5. The electrical hand tool machine of claim 1, wherein the wiring bridge (7) is made of plastic.

6. The electrical hand tool machine of claim 1, wherein a plug connector (10) is displaceable along the terminus of the wiring bridge (7).

7. The electrical hand tool machine of claim 6, wherein a compression rib (11) is arranged between the wiring bridge (7) and the plug connector (10) for fastening the plug connector (1) to the wiring bridge (7) in a friction locking manner.

8. The electrical hand tool machine of claim 7, wherein the wiring bridge (7) projecting on one side is securely connected to an electronics module (12).

9. The electrical hand tool machine of claim 8, wherein the wiring bridge (7) is bonded to the electronics module (12) using a casting mass (13).

* * * * *